US007139502B2

(12) United States Patent
Koishi et al.

(10) Patent No.: US 7,139,502 B2
(45) Date of Patent: Nov. 21, 2006

(54) PROCESS CARTRIDGE AND ELECTROPHOTOGRAPHIC IMAGE FORMING APPARATUS

(75) Inventors: Isao Koishi, Shizuoka (JP); Akiyoshi Fujita, Shizuoka (JP); Takahito Ueno, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 10/957,836

(22) Filed: Oct. 5, 2004

(65) Prior Publication Data

US 2005/0249517 A1 Nov. 10, 2005

(30) Foreign Application Priority Data

May 6, 2004 (JP) ..... 2004-137204

(51) Int. Cl.
*G03G 21/20* (2006.01)

(52) U.S. Cl. ..... 399/93; 399/111

(58) Field of Classification Search ..... 399/91, 399/92, 93, 98, 107, 111, 120
See application file for complete search history.

(56) References Cited

U.S. PATENT DOCUMENTS

| | | | | |
|---|---|---|---|---|
| 5,832,343 | A * | 11/1998 | Kobayashi et al. | 399/119 |
| 5,963,759 | A | 10/1999 | Kojima et al. | 399/111 |
| 6,324,370 | B1 | 11/2001 | Isobe et al. | 399/258 |
| 6,385,416 | B1 | 5/2002 | Horikawa et al. | 399/111 |
| 6,608,980 | B1 | 8/2003 | Murayama et al. | 399/111 |
| 6,714,752 | B1 | 3/2004 | Ueno et al. | 399/117 |
| 6,829,455 | B1 | 12/2004 | Yasumoto et al. | 399/167 |
| 6,834,175 | B1 | 12/2004 | Murayama et al. | 399/256 |
| 2002/0085854 | A1 | 7/2002 | Numagami et al. | 399/90 |
| 2002/0141788 | A1 | 10/2002 | Matsuda et al. | 399/260 |
| 2003/0049036 | A1 | 3/2003 | Ueno et al. | 399/25 |
| 2003/0133723 | A1 | 7/2003 | Fujita et al. | 399/111 |
| 2004/0062573 | A1 | 4/2004 | Matsuda et al. | 399/258 |
| 2004/0126131 | A1 | 7/2004 | Numagami et al. | 399/109 |
| 2005/0238395 | A1* | 10/2005 | Ueno et al. | 399/350 |
| 2005/0281582 | A1* | 12/2005 | Mercer | 399/114 |

FOREIGN PATENT DOCUMENTS

| | | | |
|---|---|---|---|
| JP | 4-115284 | A | 4/1992 |
| JP | 5-119674 | A | 5/1993 |
| JP | 6-35388 | A | 2/1994 |
| JP | 9-185205 | * | 7/1997 |
| JP | 11-184352 | | 7/1999 |
| JP | 2004-85649 | * | 3/2004 |

OTHER PUBLICATIONS

English Translation of Notification of Reasons for Refusal in Japanese Application No. 2004-137204, dated Apr. 25, 2006 and dispatched May 9, 2006.

* cited by examiner

*Primary Examiner*—Hoan Tran
(74) *Attorney, Agent, or Firm*—Fitzpatrick, Cella, Harper & Scinto

(57) ABSTRACT

A process cartridge detachably mountable to an electrophotographic image forming apparatus main body, including: an electrophotographic photosensitive drum; a cleaning member for removing developer adhering to the photosensitive drum; a removed developer containing portion for containing the developer removed by the cleaning member; a filter member mounted to the removed developer containing portion for allowing ventilation between the interior and exterior of the removed developer containing portion; a recess provided on the removed developer containing portion and covered with the filter member; and a communicating portion provided on the removed developer containing portion for communicating between the interior of the removed developer containing portion and the recess to ventilate therebetween.

9 Claims, 13 Drawing Sheets

X-X

XI-XI

PROCESS CARTRIDGE AND ELECTROPHOTOGRAPHIC IMAGE FORMING APPARATUS

BACKGROUND OF THE INVENTION

1. Field of the Invention

The present invention relates to a process cartridge detachably mountable to an electrophotographic image forming apparatus main body, and to an electrophotographic image forming apparatus to which the process cartridge is detachably mountable.

2. Related Background Art

Recently, an electrophotographic image forming apparatus using electrophotographic image forming process adopts a process cartridge system in which an electrophotographic photosensitive member and processing means acting thereon, such as a charging device, a developing device, and a cleaning device, are integrated into a cartridge, which is detachably mountable to an image forming apparatus main body. In the process cartridge system, the user can perform maintenance on the apparatus without relying on a serviceman. Thus, it is possible to achieve a substantial improvement in terms of operability. In view of this, the process cartridge system has come to be widely adopted in electrophotographic image forming apparatuses.

The above-mentioned cleaning device removes developer remaining on the surface of the electrophotographic photosensitive member after developer image transfer by a cleaning member. The removed developer is contained in a removed developer containing portion. With the recent increase in the service life of image forming apparatuses (process cartridges), the amount of removed developer to be contained in the removed developer containing portion has been increased. Thus, in some cases, there is provided a mechanism for carrying developer accumulated on the upper portion of the electrophotographic photosensitive member to a vacant space at the rear of the removed developer containing portion.

Apart from this, there is a demand in the market for an inexpensive, small-sized image forming apparatus for personal use. To realize this, a reduction in the size of the cartridge is necessary. Thus, when a removed developer carrying mechanism as mentioned above is adopted, an increase in the number of components, including a carrying member and a driving member, is involved, resulting in an increase in cost and size.

Thus, in making the present invention, there has been considered a construction in which an airflow is generated inside the removed developer containing portion, moving the developer with this airflow.

In this regard, there exists a known process cartridge in which an airflow is generated inside the removed developer containing portion (JP H11-184352A).

SUMMARY OF THE INVENTION

It is an object of the present invention to provide a process-cartridge capable of containing removed developer efficiently in a removed developer containing portion, and an electrophotographic image forming apparatus equipped with the same.

It is another object of the present invention to provide a process cartridge capable of moving removed developer inside the removed developer containing portion by a simple construction, and an electrophotographic image forming apparatus equipped with the same.

Further, it is another object of the present invention to provide a process cartridge including: an electrophotographic photosensitive drum; a cleaning member for removing developer adhering to the electrophotographic photosensitive drum; a removed developer containing portion for containing the developer removed by the cleaning member; a filter member mounted to the removed developer containing portion, for allowing ventilation between an interior and an exterior of the removed developer containing portion; a recess provided on the removed developer containing portion and covered with the filter member; a communicating portion provided on the removed developer containing portion for communicating between the interior of the removed developer containing portion and the recess to ventilate therebetween; a first ventilation route which, when an airflow generated in the removed developer containing portion passes through the filter member to reach the exterior, causes the airflow to pass the filter member from an exposed portion of the filter member exposed on an inner side of the removed developer containing portion; and a second ventilation route which, when an airflow generated in the removed developer containing portion passes through the filter member to reach the exterior, causes the airflow to pass the filter member from an exposed portion of the filter member exposed on an inner side of the recess.

Further, it is another object of the present invention to provide a process cartridge including: an electrophotographic photosensitive drum; a cleaning member for removing developer adhering to the electrophotographic photosensitive drum; a removed developer containing portion for containing the developer removed by the cleaning member; a filter member mounted to the removed developer containing portion for ventilating between an interior and an exterior of the removed developer containing portion; a recess provided on the removed developer containing portion and covered with the filter member; and a communicating portion provided on the removed developer containing portion for communicating between the interior of the removed developer containing portion and the recess to ventilate therebetween.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

In the following, the best mode for carrying out the present invention will be described in detail with reference to the accompanying drawings and an embodiment of the present invention shown therein. It should be noted that the functions, materials, configurations, relative arrangement, etc., of the components of the embodiments described below should not be construed restrictively unless otherwise specified.

In the following description, the expression "longitudinal direction" refers to a direction crossing (substantially perpendicular to) the direction in which the process cartridge is mounted.

[Embodiment 1]

(General Construction of the Electrophotographic Image Forming Apparatus)

Figure 2:
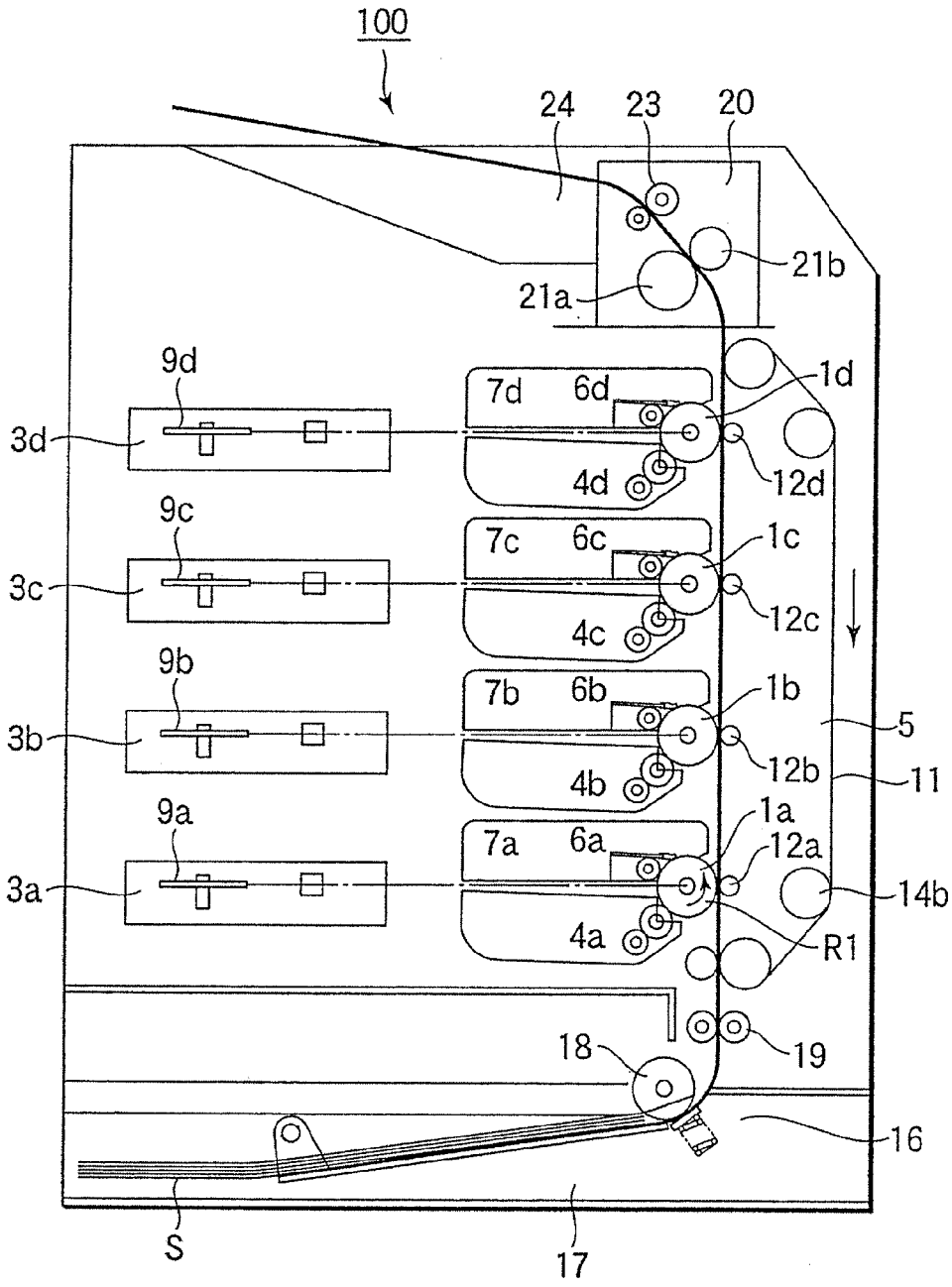
FIG. 2 is a sectional view showing the general construction of an electrophotographic image forming apparatus according to the embodiment of the present invention.

First, an electrophotographic image forming apparatus according to an embodiment of the present invention will be described with reference to a drawing. FIG. 2 is a longitudinal sectional view of the general construction of a full-color laser beam printer as an example of the electrophotographic image forming apparatus according to the embodiment of the present invention.

An electrophotographic image forming apparatus (hereinafter referred to as the "image forming apparatus") 100 shown in FIG. 2 is equipped with four electrophotographic photosensitive drums (hereinafter referred to as the "photosensitive drums") 1 (1*a*, 1*b*, 1*c*, and 1*d*) arranged side by side in the vertical direction.

The photosensitive drums 1 are rotated counterclockwise (in the direction indicated by the arrow R1 in FIG. 2) by a driving means (not shown). Components provided around the photosensitive drums 1 will be described in a sequence in accordance with the rotating direction. First, there are arranged charging devices 2 (see FIG. 3) for uniformly charging the surfaces of the photosensitive drums 1. Then, there are arranged scanner units (3*a*, 3*b*, 3*c*, and 3*d*) for applying laser beams to the photosensitive drums 1 based on image information to form electrostatic latent images. Further, there are arranged developing devices 4 (4*a*, 4*b*, 4*c*, and 4*d*) for causing developer to adhere to the electrostatic latent images to thereby develop them into developer images. Further, there is arranged an electrostatic transfer device 5 for transferring the developer images on the photosensitive drums 1 to a recording medium S. Further, there are arranged cleaning devices (6*a*, 6*b*, 6*c*, and 6*d*) for removing transfer residual developer remaining on the surfaces of the photosensitive drums 1 after transfer.

The photosensitive drums 1, the charging devices 2, the developing devices 4, and the cleaning devices are integrated into cartridges to form process cartridges 7 (7*a*, 7*b*, 7*c*, and 7*d*). In FIG. 2, the cartridges 7 are schematically depicted. Accordingly, the cartridges 7 as shown in this drawing somewhat differ in outer configuration from the cartridges as shown in the other drawings.

In the following, the above components will be described one by one in detail, starting from the photosensitive drums 1.

The photosensitive drums 1 are formed by providing photosensitive layers on the outer peripheral surfaces of aluminum cylinders with a diameter, for example, of 24 mm. The photosensitive drums 1 are rotatably supported by support members at both ends. A drive force from a drive motor (not shown) is transmitted to one end of each of the photosensitive drums 1. This causes the photosensitive drums 1 to rotate counterclockwise.

As the charging devices 2, contact-charging-type ones are used. For example, charging rollers consisting of roller-shaped conductive members are used. The charging rollers are brought into contact with the surfaces of the photosensitive drums 1. At the same time, charging bias voltage is applied to the charging rollers. As a result, the surfaces of the photosensitive drums 1 are uniformly charged. In this embodiment, the reversal developing system is adopted, so that the surfaces of the photosensitive drums 1 are charged to a negative polarity.

The scanner units (3*a*, 3*b*, 3*c*, and 3*d*) emit image light corresponding to image signals by laser diodes (not shown) and apply the light to polygon mirrors (9*a*, 9*b*, 9*c*, and 9*d*) rotated at a high speed by scanner motors (not shown). The image light reflected by the polygon mirrors is used to selectively perform exposure on the surfaces of the photosensitive drums 1, thereby forming electrostatic latent images.

Figure 3:
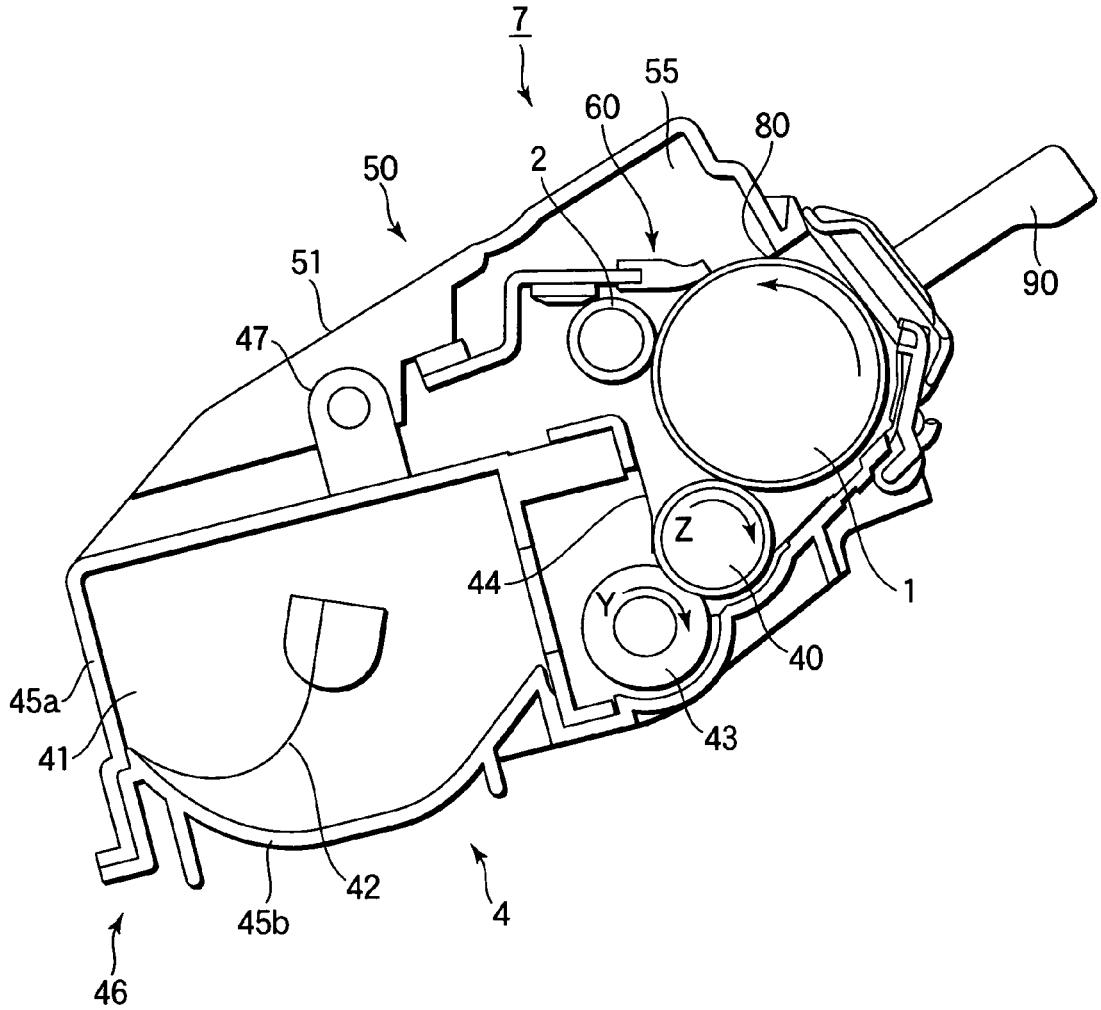
FIG. 3 is a sectional view of a process cartridge according to the embodiment of the present invention.

FIG. 3 is a longitudinal sectional view showing the construction of a process cartridge according to the embodiment of the present invention. As shown in FIG. 3, the developing devices 4 have developer containers 41 respectively containing yellow, magenta, cyan, and black developers. The developer contained in each developer container 41 is fed to a developer supply roller 43 by a developer feeding mechanism 42 provided in the developer container 41.

The developer supply roller 43 rotates clockwise (in the direction indicated by the arrow Y in FIG. 3), supplying developer to a developer sleeve 40. Further, the developer supply roller 43 rubs off the developer remaining on the developing sleeve 40 after development.

The developer supplied to a developing sleeve 40 is applied, by a developing blade 44 held in press contact with the outer periphery of the developing sleeve 40, to the outer periphery of the developing sleeve 40 rotating clockwise (in the direction indicated by the arrow Z in FIG. 3), and charge is given to the developer.

Then, a developing bias is applied to the developing sleeve 40 opposed to the photosensitive drum 1 with a latent image formed thereon. The developer to which charge has been thus given is used to form a developer image on the photosensitive drum 1 in accordance with the latent image.

As shown in FIG. 2, the electrostatic transfer device 5 is opposed to the photosensitive drums 1 (1*a*, 1*b*, 1*c*, and 1*d*), and has an electrostatic transfer belt 11 which runs while in contact therewith.

The electrostatic transfer belt 11 moves while holding the recording medium S, which is electrostatically attracted to the left-hand outer peripheral surface thereof (FIG. 2), in contact with the photosensitive drums 1. In this way, the recording medium S is conveyed to transfer positions by the electrostatic transfer belt 11, and the developer images on the photosensitive drums 1 are transferred thereto.

On the inner side of the electrostatic transfer belt 11, there are provided transfer rollers (12*a*, 12*b*, 12*c*, and 12*d*), which are held in contact with the electrostatic transfer belt 11 at positions where they are opposed to the four photosensitive drums 1*a*, 1*b*, 1*c*, and 1*d*. At the time of transfer, a bias of positive polarity is applied to these transfer rollers 12. As a result, charge of a positive polarity is applied to the recording medium S through the electrostatic transfer belt 11. Due to an electric field generated in this process, the developer images of negative polarity on the photosensitive drums 1 are transferred to the recording medium S, which is held in contact with the photosensitive drums 1.

A sheet feeding portion 16 feeds the recording medium S to the image forming portions. A sheet feeding cassette 17 can contain a plurality of recording media S. A feeding roller 18 (semicircular roller) and registration rollers 19 are driven in accordance with an image forming operation, feeding one by one the recording media S in the sheet feeding cassette 17. In this process, the leading end of each recording medium S abuts the registration rollers 19 and stops temporarily to form a loop. Thereafter, in synchronism with the running of the electrostatic transfer belt 11 and the image writing position, the recording medium S is fed to the electrostatic transfer belt 11 by the registration rollers 19.

A fixing portion 20 fixes the developer images in a plurality of colors, which have been transferred to the recording medium S, to the recording medium S. The fixing portion 20 has a rotary heating roller 21*a* and a pressurizing roller 21*b* held in press contact with the heating roller 21*a* and adapted to impart heat and pressure to the recording medium S.

That is, the recording medium S to which the developer images on the photosensitive drums 1 have been transferred is conveyed by the pressurizing roller 21*b* when passing the fixing portion 20. At the same time, the recording medium S receives heat and pressure from the heating roller 21*a*. As a result, the developer images in a plurality of colors are fixed to the surface of the recording medium S.

The recording medium S with the developer images fixed thereto is discharged to the exterior of the apparatus main body through a discharging portion 24 by discharging rollers 23, with its surface with the developer images facing downwards.

(Construction of the Process Cartridge)

Figure 4:
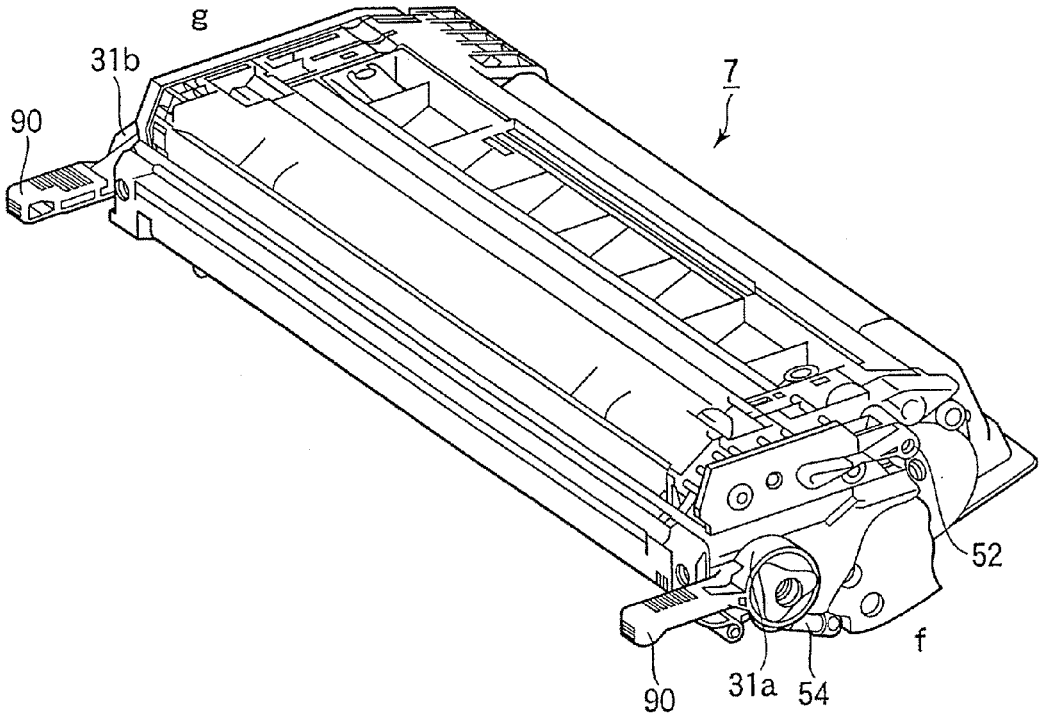
FIG. 4 is a perspective view showing the general construction of the process cartridge according to the embodiment of the present invention.

Next, the process cartridge according to this embodiment will be described with reference to FIGS. 3 and 4. FIG. 3 is a sectional view of the process cartridge of this embodiment. FIG. 4 is a perspective view showing the general construction of the process cartridge of this embodiment. The process cartridges 7*a*, 7*b*, 7*c*, and 7*d* respectively containing yellow, magenta, cyan, and black developers are of the same construction.

Each process cartridge 7 (hereinafter referred to as the "cartridge") is composed of a cleaner unit 50 and a developing unit 4. The cleaner unit 50 has the photosensitive drum 1, the charging device, and the cleaning device. The developing unit 4 has a developing means for developing an electrostatic latent image on the photosensitive drum 1.

In the cleaner unit 50, the photosensitive drum 1 is rotatably mounted to a cleaning frame 51 through bearing members (31*a* and 31*b*). Provided in the periphery of the photosensitive drum 1 are the charging means 2, a cleaning member (cleaning-blade) 60, and a flexible sheet member (a scooping member) 80. The charging means 2 uniformly charges the photosensitive layer provided on the outer peripheral surface of the photosensitive drum 1. The cleaning member (the cleaning blade) 60 removes the developer (residual developer) adhering to the photosensitive drum 1 after transfer. The residual developer (removed developer) removed from the surface of the photosensitive drum 1 by the cleaning member 60 is contained in a removed developer containing portion 55 provided in the cleaning frame 51.

Further, the transfer residual developer on the photosensitive drum 1 passes the portion where the flexible sheet member 80 abuts the photosensitive drum 1 and reaches the position of the cleaning member 60. The residual developer removed from the photosensitive drum 1 by the cleaning member 60 is prevented from leaking to the exterior of the cleaning frame 51 by appropriately setting the abutting condition of the flexible sheet member 80.

The developing unit 4 has the developing sleeve 40 which rotates in the direction of the arrow Z while maintaining a minute gap between itself and the photosensitive drum 1, and developing frames 45*a* and 45*b* containing developer.

The developing frames 45*a* and 45*b* are connected to each other by, for example, ultrasonic welding, to form a developer container unit 46.

The developing sleeve 40 is rotatably supported by the developer container unit 46 through the bearing members. Further, provided in the periphery of the developing sleeve 40 are the developer supply roller 43 which rotates in the direction of the arrow Y while in contact with the developing sleeve 40, and the developing blade 44. Further, inside the developer container unit 46, there is provided the developer feeding mechanism 42. The developer feeding mechanism 42 agitates the developer contained in the developer container unit 46, and feeds it to the developer supply roller 43.

The cartridge 7 is assembled by mating connecting holes 47 provided at both ends of the developer containing unit 46 with support holes 52 and 53 provided at both ends of the cleaning frame 51 of the cleaner unit 50, and by inserting pins (not shown) from both sides of the cleaner unit 50. This realizes a suspension structure in which the entire developing unit 4 is suspended so as to be swingable with respect to the cleaner unit 50.

Further, the developing unit 4 is urged toward the photosensitive drum 1 by pressurizing springs 54 around the support holes 52 and 53 so as to bring the developing sleeve 40 into contact with the photosensitive drum 1.

At the time of development, the developer contained in the developer container 41 is fed to the developer supply roller 43 by the developer feeding mechanism 42. The developer supply roller 43 rotating in the direction of the arrow Y is rubbed against the developing sleeve 40 rotating in the direction of the arrow Z to thereby supply developer to the developing sleeve 40. As a result, the developer is carried by the developing sleeve 40.

As the developing sleeve 40 rotates, the developer carried by the developing sleeve 40 moves to the position where the developing blade 44 abuts the developing sleeve 40. The developing blade 44 regulates the developer layer to a predetermined thickness. At the same time, a predetermined amount of charge is given to the developer.

As the developing sleeve 40 rotates, the developer in the form of a thin layer on the developing sleeve 40 is fed to the developing portion, where the photosensitive drum 1 and the developing sleeve 40 are in close proximity to each other. In the developing portion, a developing bias applied to the developing sleeve 40 from a power source (not shown) causes the developer to adhere to the electrostatic latent image formed on the surface of the photosensitive drum 1. As a result, the electrostatic latent image is developed.

On the other hand, the developer remaining on the surface of the developing sleeve 40 without contributing to the development of the electrostatic latent image is returned to the developer container unit 46 as the developing sleeve 40 rotates. At the position where the developing sleeve 40 and the developer supply roller 43 are rubbed against each other, the developer is separated from the developing sleeve 40 and collected. The collected developer is mixed with the remaining developer in the developer container unit 46 and agitated by the developer feeding mechanism 42.

(Method of Attaching/Detaching the Process Cartridge to/from the Electrophotographic Image Forming Apparatus Main Body)

Next, a method of attaching/detaching the process cartridge 7 to/from the image forming apparatus main body 100 will be described with reference to FIG. 5.

Figure 5:
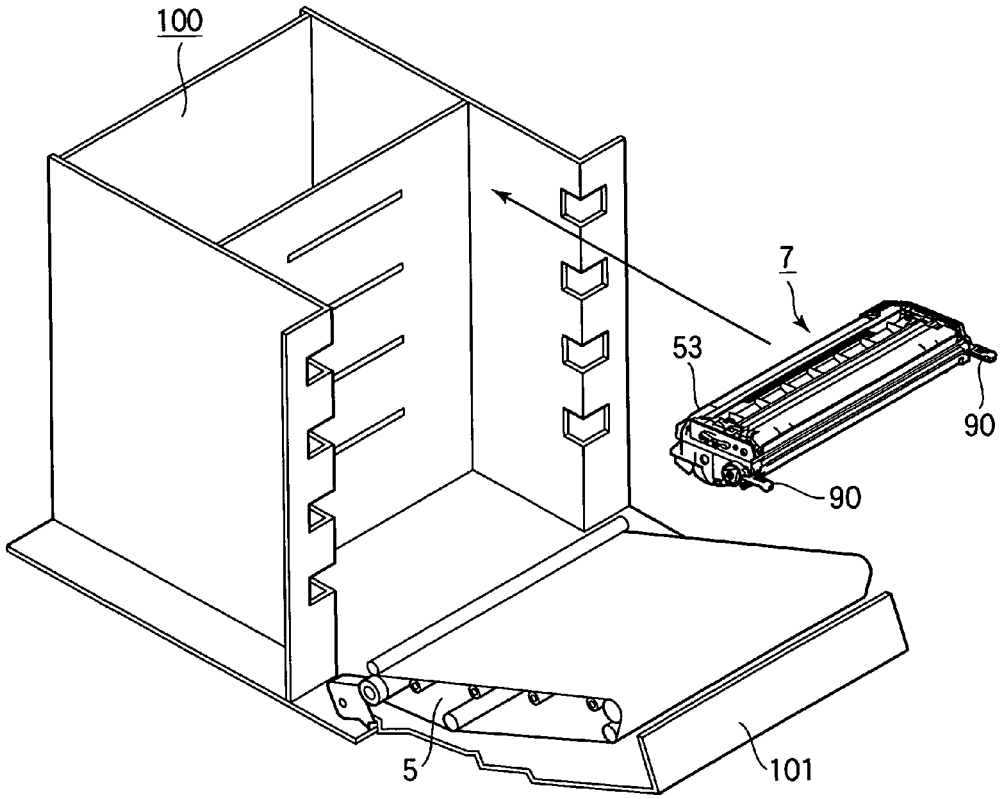
FIG. 5 is a schematic perspective view showing how the process cartridge is mounted to the main body of the electrophotographic image forming apparatus according to the embodiment of the present invention.

As shown in FIG. 5, the image forming apparatus main body 100 has a front cover 101 which is rotatable with respect to the image forming apparatus main body 100. On the inner side of the front cover 101 (on the inner side of the apparatus main body 100 with the front cover 101 closed), the electrostatic transfer device 5 is rotatably provided. The process cartridge 7 can be attached to and detached from the image forming apparatus main body 100 when the front cover 101 and the electrostatic transfer device 5 are open.

Grip members 90 are provided at the ends of the process cartridge 7 in the vicinity of electrophotographic photosensitive member support portions. During the attachment/detachment of the cartridge, the grip members 90 protrude on the main body front door 101 side.

The process cartridge 7 is mounted to the image forming apparatus main body 100 by means of a mounting portion provided inside the image forming apparatus main body 100 which allows the process cartridge to be detachably mounted. In this embodiment, a guide rail portion (not shown) constituting the mounting portion and an insertion guide portion (not shown) provided on the process cartridge 7 are engaged with each other. This enables the process cartridge 7 to be detachably mounted to the image forming apparatus main body 100.

(Filter Construction of the Cleaning Device)

Figure 1:
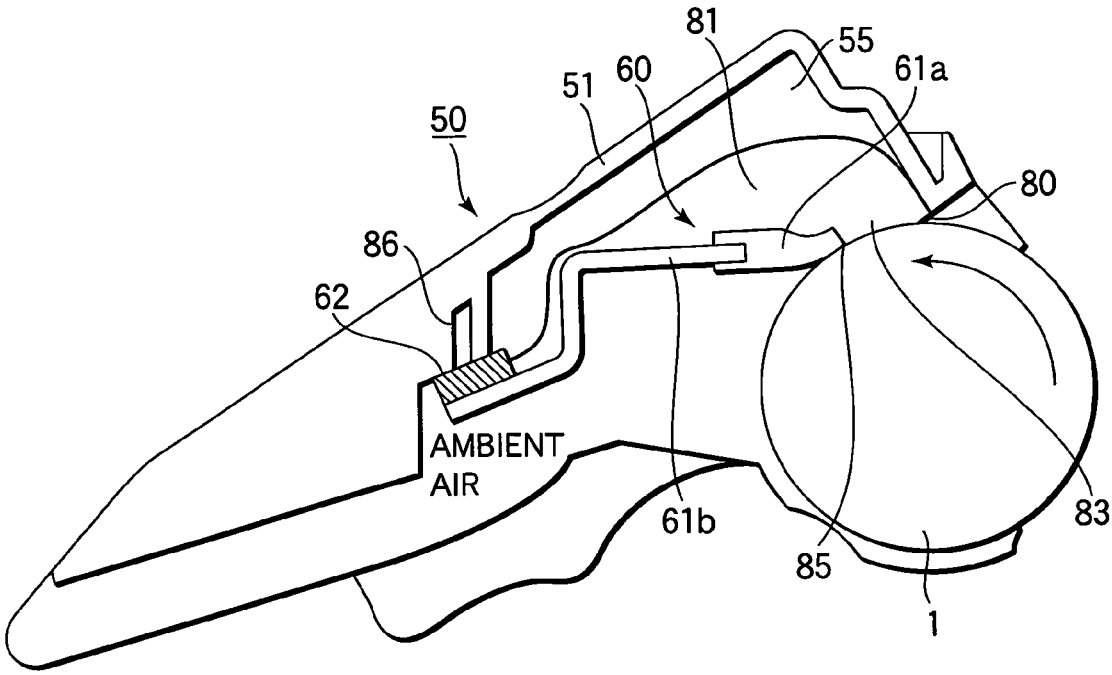
FIG. 1 is a longitudinal sectional view of a cleaner unit according to an embodiment of the present invention.

Next, the filter construction of the present invention will be described with reference to FIGS. 1, 3, and 6 through 9. FIG. 1 is a longitudinal sectional view of the cleaner unit 50 forming the process cartridge 7 of this embodiment.

As shown in FIG. 1, the cleaner unit 50 has the photosensitive drum 1, the cleaning member 60, and the cleaning frame 51 supporting/fixing the photosensitive drum 1 and the cleaning member 60.

In this embodiment, the cleaning member 60 has a substantially Z-shaped metal sheet 61*b* obtained by bending a flat plate at two positions in directions parallel to the rotation axis of the photosensitive drum 1, and a rubber blade 61*a* integrally formed at the forward end of the metal sheet 61*b*. Positioning is effected on the cleaning member 60 with respect to the cleaning frame 51, and the cleaning member 60 is fixed to the cleaning frame 51 by a screw. The forward end of the blade 61*a* is held in press contact with the photosensitive drum 1 by a fixed intrusion amount.

The removed developer containing portion 55 for containing removed developer 81 has the metal sheet 61*b* of the cleaning member 60 and the cleaning frame 51. Further, in the gap between the sheet metal 61*b* and the cleaning frame 51, there is provided a filter member 62 extending in the longitudinal direction of the cleaning member 60. The filter member 62 also serves as a seal.

In this embodiment, the filter member allows ventilation between the interior and exterior of the removed developer containing portion 55. There are no particular limitations regarding the filter member 62 as long as it has pores and passages small enough to allow the passage of substantially no developer but large enough to allow the passage of air. More specifically, one with pores with a size of several μm to several tens of μm is preferable. As the material of the filter member 62, it is possible to suitably use, for example, one with a filtering effect, such as foamed polyurethane.

In this way, the removed developer containing portion 55 is composed of at least two components, and the filter member 62 is provided between the two components. Due to this construction, the filter member 62 can be installed when assembling the two components. That is, the filter member 62 can be easily constructed and arranged.

Further, of the at least two components forming the removed developer containing portion 55, one constitutes the metal sheet 61*b*, which is a part of the cleaning member 60. This contributes to reducing the number of components.

Figure 6:
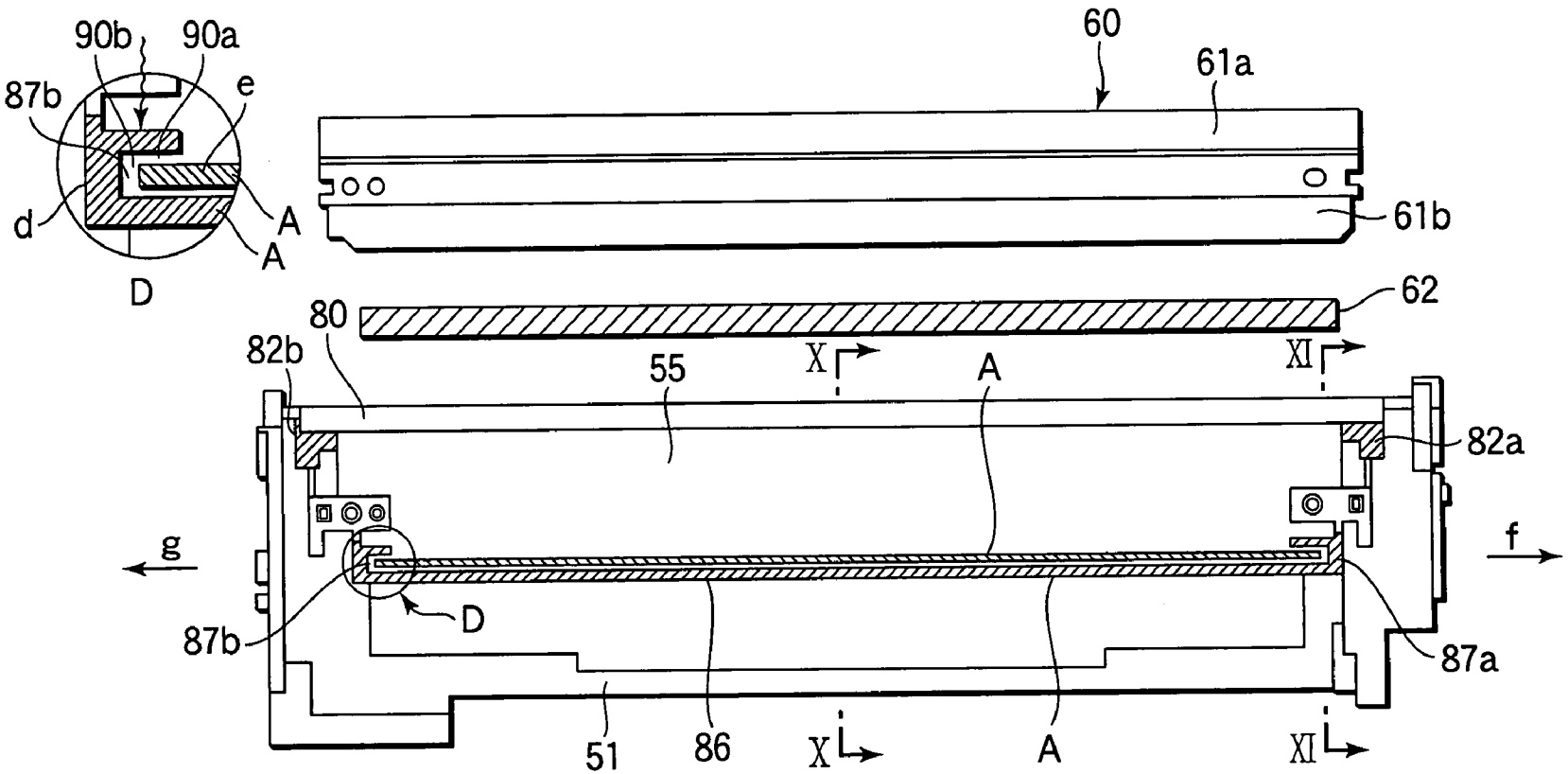
FIG. 6 is an exploded sectional view as seen from below and a partial end-portion enlarged view of the cleaner unit according to the embodiment of the present invention.

Further, a flexible sheet member 80 for collecting removed developer 81 abuts the photosensitive drum 1. The flexible sheet member 80 prevents removed developer 81 from leaking through a reception opening 83. Further, at the longitudinal end portions of the photosensitive drum 1, there are portions where neither the cleaning member 60, nor the flexible sheet member 80 abuts. To prevent removed developer from leaking through gaps formed at these portions, there are mounted, as shown in FIG. 6, developer leakage preventing members 82*a* and 82*b* formed of felt or the like. FIG. 6 is an exploded sectional view of the cleaner unit 50 as seen from below. The cleaning member 60 and the filter member 62 are separated from the cleaning frame 51.

As shown in FIG. 1, developer remaining on the photosensitive drum 1 after transfer is scraped off and removed by the cleaning member 60 before the photosensitive drum 1 is charged again. The removed developer is collected by the flexible sheet member 80 which abuts the photosensitive drum 1. Then, the developer is collected through the reception opening 83 formed in the removed developer containing portion 55 and is contained in the removed developer containing portion 55.

Figure 7:
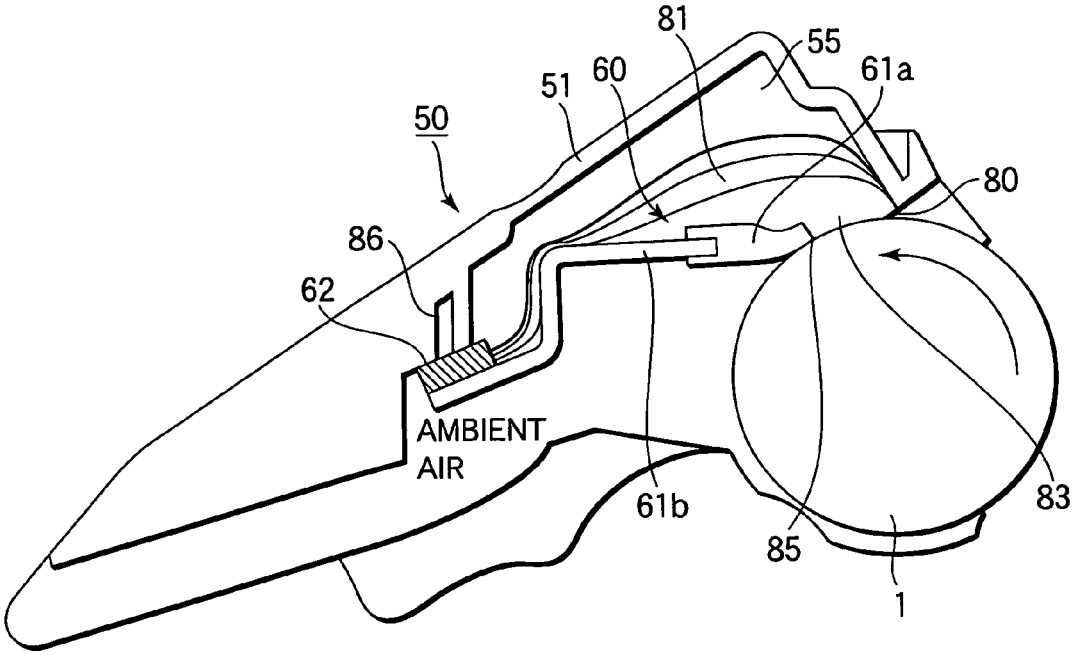
FIG. 7 is a longitudinal sectional view of the cleaner unit according to the embodiment of the present invention.
Figure 8:
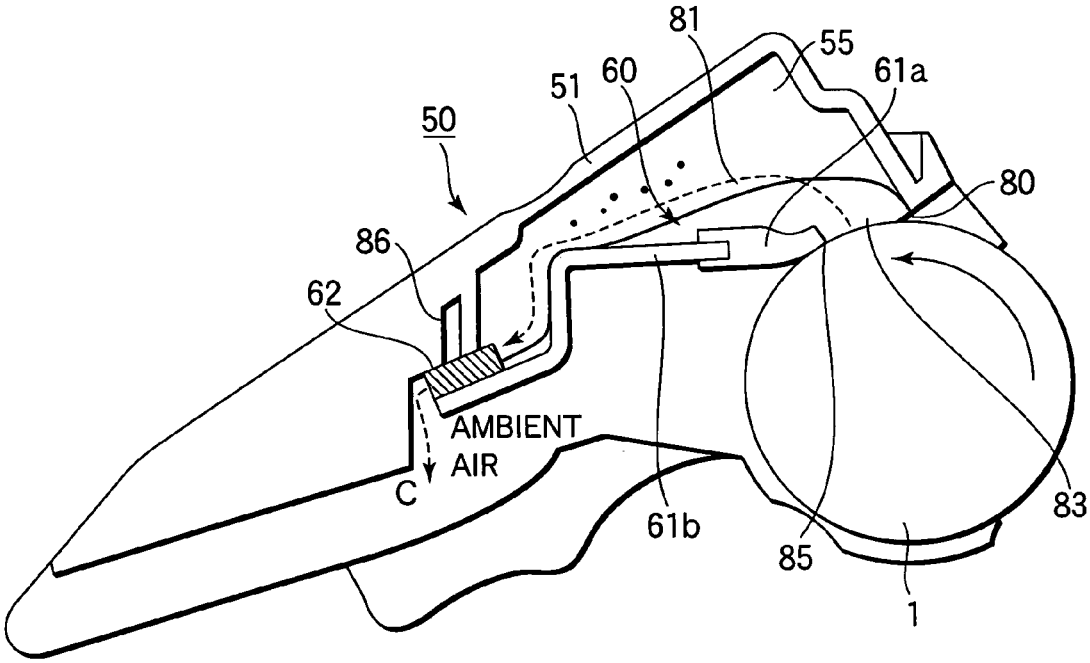
FIG. 8 is a sectional view showing how air flows inside the cleaner unit according to the embodiment of the present invention.

FIG. 7 is a longitudinal sectional view of the cleaner unit 50, showing the accumulation with the passage of time of the removed developer 81 in three stages. As shown in FIG. 7, the removed developer 81 is gradually accumulated so as to fill the space in the upper portion of the removed developer containing portion 55.

In view of this, in this embodiment, there is provided, as shown in FIG. 1, in the gap between the metal sheet 61*b* of the cleaning member 60 and the cleaning frame 51, instead of a highly hermetic seal member, a filter member 62 endowed, in a well-balanced manner, with the contradictory properties of breathability and airtightness. Thus, ventilation is secured between the interior and the exterior of the removed developer containing portion 55. Due to this construction, de-pressurization is effected through the filter 62 in order to mitigate the increase in inner pressure due to the collection of the removed developer in the removed developer containing portion 55. At the same time, there is generated an airflow heading for the filter member 62 as indicated by the dashed arrow in FIG. 8. As a result, the collected developer moves with the airflow from the portion in the vicinity of the opening 83 toward the back side of the containing portion 55. Thus, it is possible to reduce the amount of developer remaining in the vicinity of the opening 83. As a result, it is possible to achieve an improvement in terms of the ease with which removed developer is carried to the rear portion of the removed developer containing portion 55. That is, it is possible to mitigate the accumulation of the removed developer heading for the upper portion of the removed developer containing portion 55, and to promote the accumulation of the removed developer in the rear portion (back side) of the removed developer containing portion 55.

Figure 9:
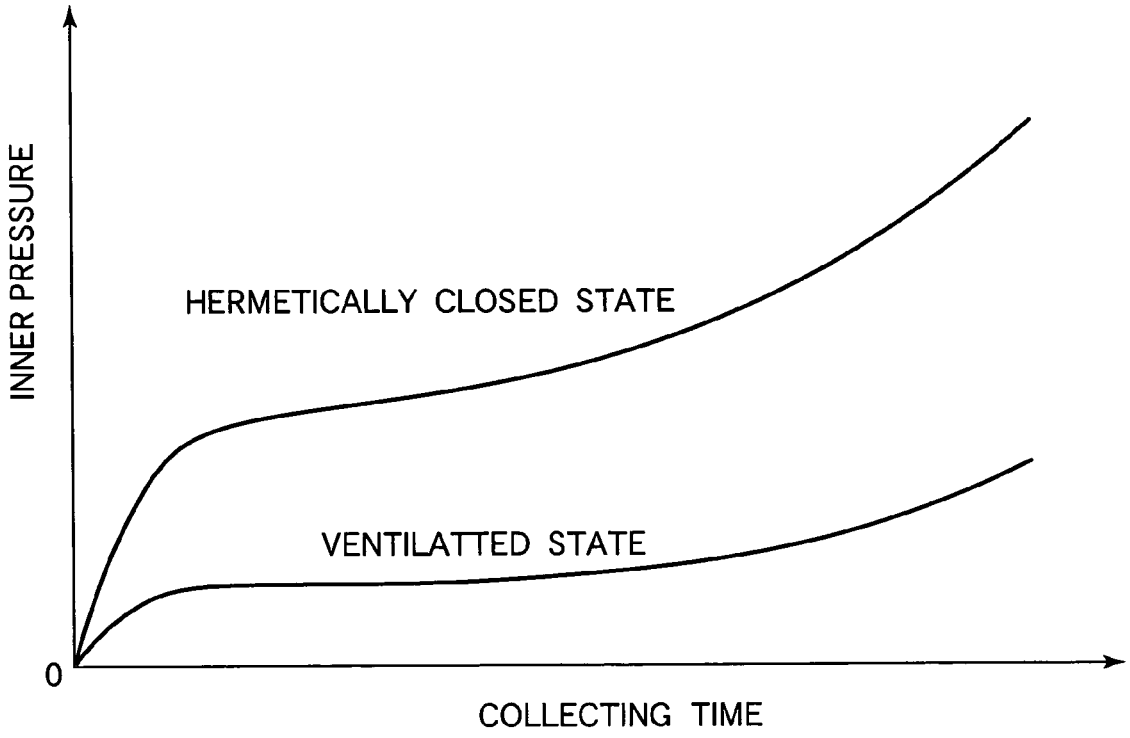
FIG. 9 is a diagram illustrating changes in inner pressure in a removed developer containing portion according to the embodiment of the present invention and Comparative Example.

Here, for comparison with the above-described embodiment, there was prepared another type of cleaner unit (not shown) with a removed developer containing portion in which the gap where the filter member 62 is arranged is filled with adhesive or the like, thus creating a hermetically closed state. A comparison was made between the hermetically closed state and the ventilated state of the removed developer containing portion 55 in terms of changes in the inner pressure due to the collection of removed developer. FIG. 9 is a graph showing changes in inner pressure in the hermetically closed state (Comparative Example) and the ventilated state (Embodiment). The horizontal axis indicates collecting time, and the vertical axis indicates inner pressure. The rate at which removed developer 81 is collected is made the same for the two cases by making the collecting time and the collection amount the same.

As shown in FIG. 9, in the ventilated state, the increase in inner pressure is mitigated, and a low pressure is maintained until the latter half of the endurance test. In contrast, in the hermetically closed state, a pressure higher than that in the ventilated state is to be observed from the initial stage of the endurance test. The above results indicate the ventilation effect due to the arrangement of the filter member 62. Further, the above results show that, by effecting ventilation of the interior of the removed developer containing portion 55, it is possible to mitigate the increase in inner pressure.

Further, as shown in FIG. 6, as a feature of this embodiment, to mount the filter member 62, there are provided seat surfaces A on the cleaning frame 51 constituting the removed developer containing portion 55. In the seat surface A on which the filter member 62 is arranged, there is provided a recess 86 with a width of 1 mm extending in the longitudinal direction of the cleaning member 60. In the vicinity of the longitudinal ends of the cleaning member 60, there are provided communicating portions 87*a* and 87*b* that communicate between the recess 86 and the removed developer containing portion 55 so as to allow ventilation therebetween. At the communicating portions 87*a* and 87*b*, the removed developer containing portion 55 communicates with the exterior through the filter member 62. Here, the recess 86 is covered with the filter member 62, whereby the portion of the filter member 62 opposed to the recess 86 is not easily covered with removed developer. Thus, it is possible to secure a satisfactory ventilation between the interior and exterior of the removed developer containing portion 55.

Figure 10:
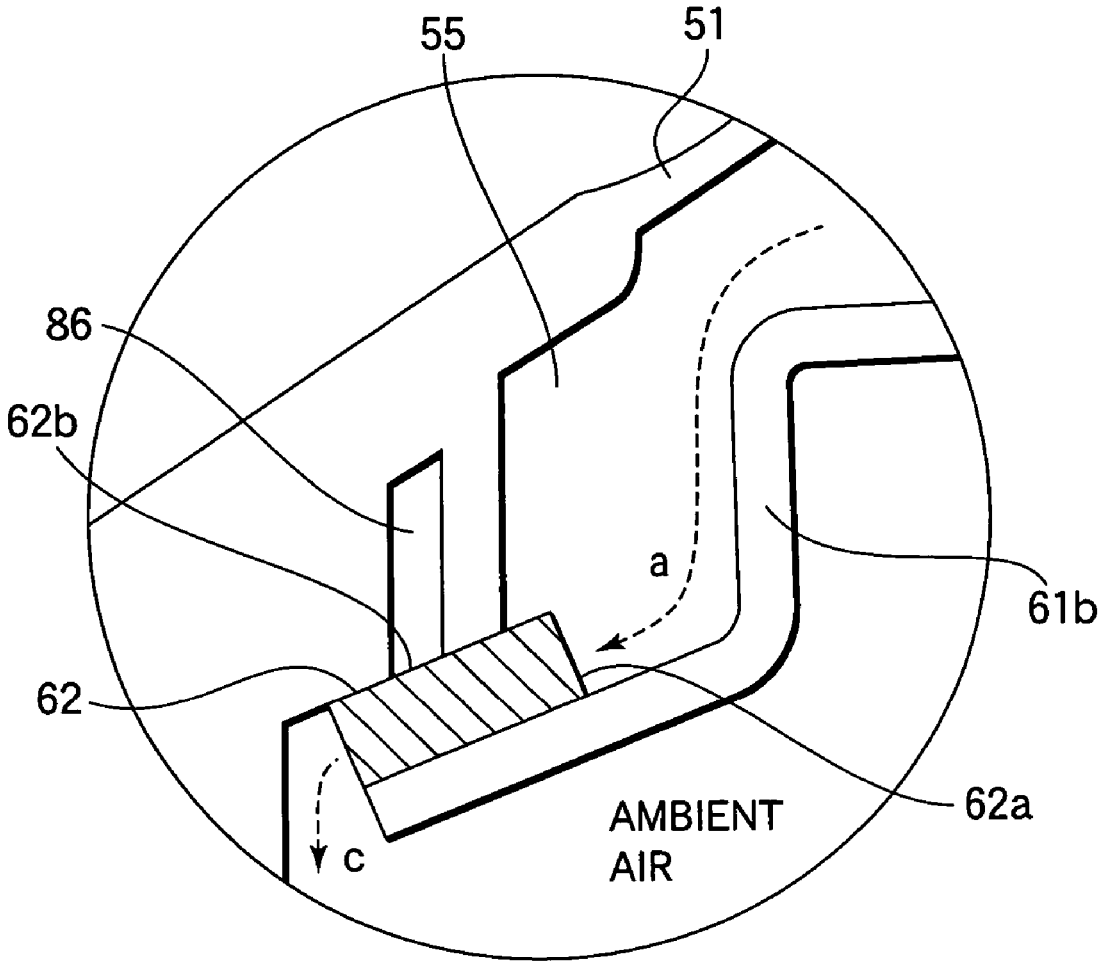
FIG. 10 is a sectional view of the cleaner unit shown in FIG. 6, taken along the line X—X.
Figure 11:
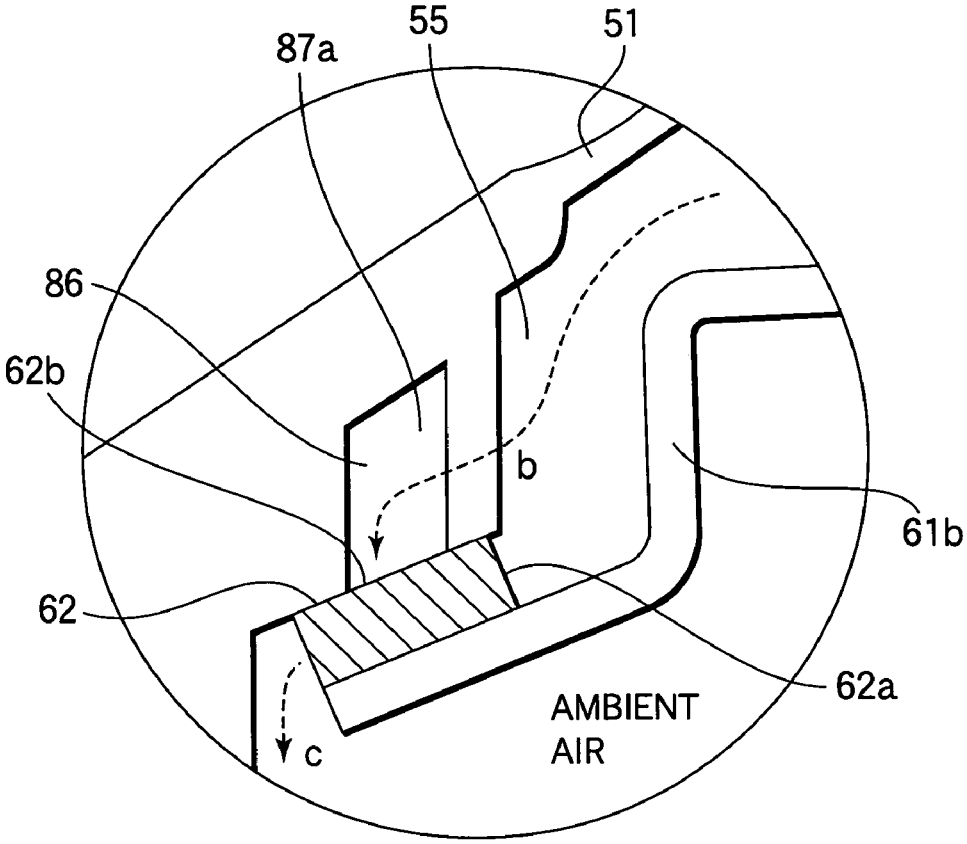
FIG. 11 is a sectional view of the cleaner unit shown in FIG. 6, taken along the line XI—XI.

To described this in more detail, the state after the assembly of the cleaner unit 50 is depicted in two separate sectional views. FIG. 10 is a sectional view (taken along the line X—X) of the longitudinal center of the cleaner unit 50. FIG. 11 is a sectional view (taken along the line XI—XI) of the communicating portion 87*a* on the driving side "f" of the process cartridge 7. The construction of the communicating portion 87*a* shown in the sectional view of FIG. 11 taken along the line XI—XI is linearly symmetrical with respect to the reference line X—X. Thus, the construction of the communicating portion 87*a* is the same as the construction of the communicating portion 87*b* provided on the non-driving side "g" of the process cartridge 7.

As shown in FIG. 10, in the section X—X, the recess 86 is opposed exclusively to the upper surface of the filter member 62, and is not connected to the removed developer containing portion 55 so as to allow ventilation. In contrast, as shown in FIG. 11, in the section XI—XI, the recess 86 communicates with the removed developer containing portion 55 through the communicating portion 87*a* (87*b*) so as to allow ventilation.

Usually, when the recess 86 and the communicating portion 87*a* (87*b*) are not provided, ventilation is solely effected on the ventilation route "a" (see FIG. 10) for the filter member 62 which is perpendicular to the longitudinal direction of the cleaning member 60. That is, an airflow generated inside the removed developer containing portion 55 passes through the filter member 62 and flows to the exterior of the removed developer containing portion 55. In contrast, in this embodiment, there is provided, in addition to the first ventilation route "a" in which the airflow inside the removed developer containing portion 55 passes through a first exposed portion 62*a* of the filter member 62 exposed on the removed developer containing portion 55 side (opposed to the interior of the removed developer containing portion 55), a second ventilation route "b" in which the airflow in the removed developer containing portion 55 passes through a second exposed portion 62*b* of the filter member 62 exposed on the recess 86 side.

That is, by way of the communicating portion 87*a* (87*b*) and the recess 86, ventilation of the ventilation route "b", communicated to the second exposed portion 62*b* of the filter member 62, is made possible. Here, the second exposed portion 62*b* is provided at a position where it cannot be seen through the opening 83. That is, the second exposed portion 62*b* is not opposed to the interior of the removed developer containing portion 55. Thus, the second exposed portion is not covered with removed developer.

Further, the second ventilation route "b" has a ventilation route substantially parallel to the longitudinal direction of the cleaning member 60. As a result, it is possible to enhance the ventilation effect and to feed the removed developer in a more satisfactory manner while maintaining the sealing property.

Even if the first exposed portion 62*a* of the filter member 62 is covered with removed developer, the airflow inside the removed developer containing portion 55 passes through the second exposed portion 62*b* by way of the second ventilation route "b". This makes it possible to perform the feeding of removed developer for a long period of time in a stable manner.

When, in the construction in which, as shown in FIG. 5, the grip members 90 of the cartridge are provided on the front surface of the photosensitive drum 1 (the surface to be exposed at the time of image formation), the user holds the grip members 90 to attach/detach the cartridge to/from the image forming apparatus main body 100, the rear end (the side opposite to the side where the grip members 90 are provided) may be lowered depending on the position of the center of gravity, causing the cartridge 7 to be inclined.

Figure 12:
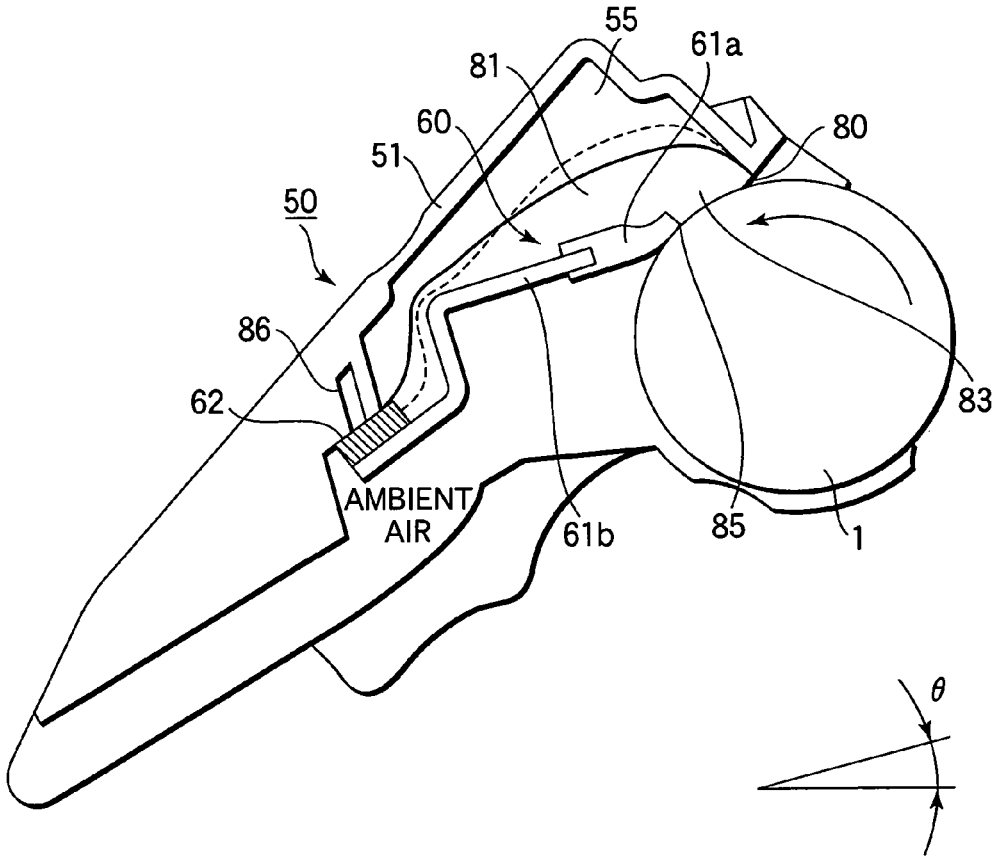
FIG. 12 is a longitudinal sectional view showing the cleaner unit according to the embodiment of the present invention in a state in which it is inclined with respect to a horizontal plane.

FIG. 12 is a longitudinal sectional view showing a state in which the cleaner unit 50 is inclined by an angle θ with respect to a horizontal plane. In this case, when a considerable amount of removed developer 81 is contained in the removed developer containing portion 55, the accumulation sectional configuration of the removed developer prior to attachment/detachment, indicated by the dashed line in FIG. 12, may be transformed into the accumulation sectional configuration as indicated by the solid line as a result of the removed developer being gathered in the rear portion of the removed developer containing portion 55 due to the tipping motion of the cartridge at the time of attaching/detaching operation.

In this case, the removed developer 81 is accumulated on the removed developer containing portion 55 side ventilation surface of the filter member 62 to block the ventilation route "a" as shown in FIG. 10, so that the ventilation effect by the ventilation route "a" may not be obtained. Even in such a case, according to this embodiment, the ventilation through the ventilation route "b" is effected, making it possible to perform the feeding of the removed developer.

Further, when the user performs the operation of attaching/detaching the process cartridge, the cartridge 7 may be inclined to the driving side "f" or the non-driving side "g" using the reference line X—X in FIG. 6 as the rotation axis. In this case, there is the possibility of the removed developer 81 accumulated in the removed developer containing portion 55 being over-gathered on the driving side "f" or the non-driving side "g". In this case, while one communicating portion 87*a* (87*b*) may be clogged, the other communicating portion 87*b* (87*a*) is not clogged. Thus, it is possible to maintain the ventilation effect.

In the above-described embodiment, the filter member 62 is provided in the gap between the cleaning frame 51, constituting the removed developer containing portion 55, and the cleaning member 60. However, this embodiment is not restricted to this construction; it is also possible to provide the filter member in, for example, a slit-like gap provided in a single member. Alternatively, it is also possible to provide the filter member in a gap formed by three or more components.

In this embodiment, the communicating portions 87*a* and 87*b* between the recess 86 and the removed developer containing portion 55 are provided solely on the cleaning frame 51 side surface of the seat surface A, where the filter member 62 is arranged. However, if there is sufficient space to form a recess and communicating portions, it is also possible to provide them also on the opposing seat surface. In this case, it is possible to obtain a further enhanced ventilation effect.

Further, regarding the communicating portions communicating with the removed developer containing portion 55, a ventilation effect can naturally be obtained by providing such a communicating portion at one arbitrary position (at one longitudinal end of the recess 86). However, by providing the communicating portions 87*a* and 87*b* communicating with the removed developer containing portion 55 at both longitudinal ends of the cleaning member 60, it is possible to maintain the ventilation effect even if removed developer 81 inside the removed developer containing portion 55 is over-gathered on the driving side "f" or the non-driving side "g". For a further enhanced effect, it is also possible to provide the communicating portions 87*a* (87*b*) at three or more positions, i.e., at positions other than the longitudinal ends.

Figure 13:
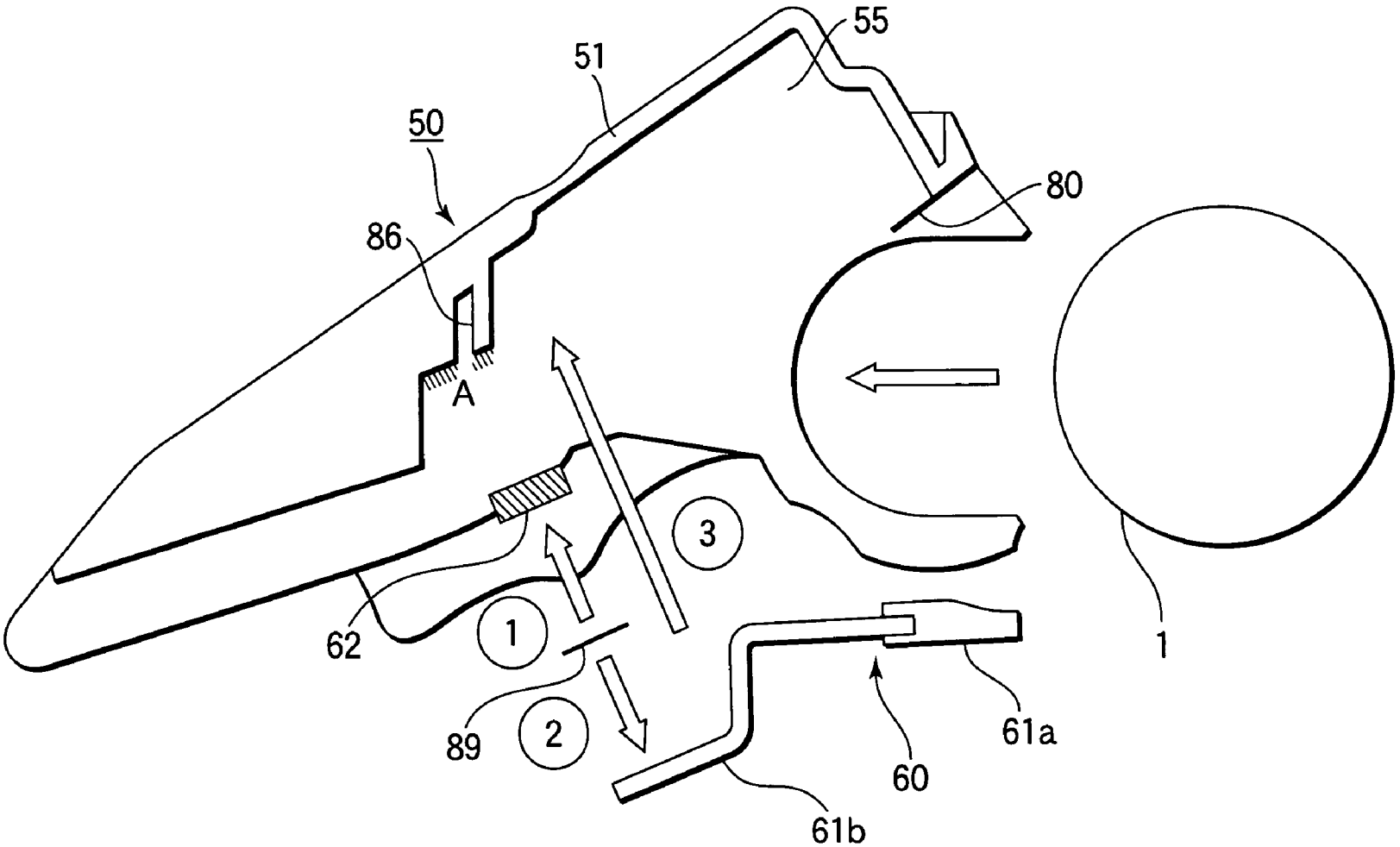
FIG. 13 is an exploded sectional view for illustrating how the cleaner unit according to the embodiment of the present invention is assembled.

FIG. 13 shows the procedures for mounting the various components to the cleaning frame 51 of this embodiment.

In this embodiment, the mounting procedures, numbered in the drawing, are as follows: (1) a double-faced tape 89 is attached to the filter member 62. (2) The filter member 62 is attached to the metal sheet 61*b* of the cleaning member 60. (3) Thereafter, the cleaning member 60 is mounted to the cleaning frame 51. To attain the proper positional relationship between the seat surface A and the filter member 62, there is determined an attachment reference for the filter member 62 on the sheet metal 61*b*. This makes it possible to perform the assembly in a stable manner.

Further, the filter member 62 is preferably arranged at a position spaced apart from the cleaning position 85 (see FIG. 12) at which the removed developer 81 remaining on the photosensitive drum 1 is removed in the removed developer containing portion 55. This makes it possible to feed the developer to the rear portion of the removed developer containing portion 55, making it possible to maintain a more satisfactory cleaning effect for a long period of time.

Alternatively, the filter 62 may be arranged on the opposite side of the opening 83, formed in the removed developer containing portion 55 in order to collect developer from the photosensitive drum 1, with respect to the cleaning position of the cleaning member 60. In this arrangement, as the photosensitive drum 1 rotates, the removed developer remaining at the cleaning position is gradually fed toward the filter member 62 provided in the rear portion of the removed developer containing portion 55. Thus, it is possible to accommodate more removed developer in the removed developer containing portion 55, making it possible to maintain a more satisfactory cleaning property for a long period of time.

More preferably, the filter member 62 is arranged at a position most spaced apart from the cleaning position in the removed developer containing portion 55. This makes it possible to accommodate still more removed developer in the removed developer containing portion.

Further, it is desirable for the filter member 62 to be arranged below the cleaning position of the cleaning member 60, with the process cartridge 7 mounted to the image forming apparatus main body 100. Due to this arrangement, the removed developer fed from the cleaning position is fed more easily toward the filter member 62 due to the airflow heading for the filter member 62.

Further, as shown in FIG. 6, in order to prevent inflow of developer in a direction crossing the longitudinal direction of the cleaning member 60, there are provided, at each of the communicating portions 87*a* and 87*b* between the recess 86 and the removed developer containing portion 55, a combination of a recess "d" and a protrusion "e" opposed to each other, with the protrusion entering the recess. That is, recesses 90*a* and 90*b* are provided such that the inflow route for the developer is bent. In other words, the communicating portion 87*a* (87*b*) has a passage route substantially parallel to the longitudinal direction of the cleaning member 60. Due to this arrangement, when removed developer 81 is fed to the rear portion of the removed developer containing portion 55, or when the user tips the process cartridge 7 to recover the process cartridge 7 to thereby cause removed developer 81 to be over-gathered in the rear portion of the removed developer containing portion 55, inflow of the removed developer 81 into the communicating portions 87*a* and 87*b* for ventilation is prevented. This makes it further possible to maintain the ventilation effect.

The same effect can be obtained by providing a plurality of pairs of recesses and protrusions in the communicating portions 87*a* and 87*b*.

The above-described construction can also be utilized, for example, in the developing device 4 shown in FIG. 3, and is effective as a means for mitigating an increase in inner pressure and as a means for making the circulation of developer satisfactory.

As described above, according to the present invention, it is possible to contain removed developer efficiently in the removed developer containing portion. Further, according to the present invention, it is possible to move removed developer inside the removed developer containing portion with a simple construction. Further, according to the present invention, it is possible to move the developer inside the removed developer containing portion by an airflow.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-137204 filed May 6, 2004, which is hereby incorporated by reference herein.

What is claimed is:

1. A process cartridge detachably mountable to an electrophotographic image forming apparatus main body, said process cartridge comprising:

an electrophotographic photosensitive drum;

a cleaning member configured and positioned to remove developer adhering to said electrophotographic photosensitive drum;

a removed developer containing portion configured and positioned to contain the developer removed by said cleaning member;

a filter member mounted to said removed developer containing portion, and configured and positioned to allow ventilation between an interior and an exterior of said removed developer containing portion;

a recess provided on said removed developer containing portion and covered with said filter member;

a communicating portion provided on said removed developer containing portion configured and positioned to communicate between the interior of said removed developer containing portion and said recess to ventilate therebetween;

a first ventilation route which, when an airflow generated in said removed developer containing portion passes through said filter member to reach the exterior, causes the airflow to pass said filter member from an exposed portion of said filter member exposed on an inner side of said removed developer containing portion; and a second ventilation route which, when an airflow generated in said removed developer containing portion passes through said filter member to reach the exterior, causes the airflow to pass said filter member from an exposed portion of said filter member exposed on an inner side of said recess.

2. A process cartridge detachably mountable to an electrophotographic image forming apparatus main body, said process cartridge comprising:

an electrophotographic photosensitive drum;

a cleaning member configured and positioned to remove developer adhering to said electrophotographic photosensitive drum;

a removed developer containing portion configured and positioned to contain the developer removed by said cleaning member;

a filter member mounted to said removed developer containing portion and configured and positioned to provide ventilation between an interior and an exterior of said removed developer containing portion;

a recess provided on said removed developer containing portion and covered with said filter member; and a communicating portion provided on said removed developer containing portion for communicating between the interior of said removed developer containing portion and said recess to provide ventilation therebetween.

3. A process cartridge according to claim 1 or 2, wherein said recess is provided so as to extend along a longitudinal direction of said cleaning member mounted to said removed developer containing portion.

4. A process cartridge according to claim 1 or 2, wherein said communicating portion is provided at each of both longitudinal ends of said recess.

5. A process cartridge according to claim 1 or 2, wherein said filter member is arranged on an opposite side, with respect to a cleaning position of said cleaning member, of an opening formed in said removed developer containing portion through which developer is collected from said electrophotographic photosensitive drum.

6. A process cartridge according to claim 1 or 2, wherein, in said removed developer containing portion, said filter member is arranged at a position most spaced apart from said cleaning position.

7. A process cartridge according to claim 1 or 2, wherein said filter member is arranged at a position lower than said cleaning position.

8. A process cartridge according to claim 1 or 2, wherein said communicating portion comprises a recess in which at least a pair of a recess and a protrusion are opposed to each other, with the protrusion entering said recess, and in which an inflow route for developer is bent.

9. An electrophotographic image forming apparatus comprising:

a mounting portion; and said process cartridge as claimed in claim 1 or 2 and detachably mounted to said mounting portion.

* * * * *

UNITED STATES PATENT AND TRADEMARK OFFICE

CERTIFICATE OF CORRECTION

PATENT NO. : 7,139,502 B2
APPLICATION NO. : 10/957836
DATED : November 21, 2006
INVENTOR(S) : Isao Koishi et al.

It is certified that error appears in the above-identified patent and that said Letters Patent is hereby corrected as shown below:

IN THE DRAWINGS:

Sheet 9, Fig. 9, "VENTILLATED" should read --VENTILATED--.

COLUMN 1:

Line 59, "process-cartridge" should read --process cartridge--.

COLUMN 9:

Line 66, "described" should read --describe--.

Signed and Sealed this

Twenty-ninth Day of July, 2008

JON W. DUDAS
*Director of the United States Patent and Trademark Office*